US007114292B2

(12) United States Patent
Chiang

(10) Patent No.: US 7,114,292 B2
(45) **Date of Patent: *Oct. 3, 2006**

(54) ADJUSTABLE AUTOMATIC POSITIONING HINGE FOR GLASS DOORS

(76) Inventor: Fanny Chiang, 11 Fl. -4, No. 16, Chungming S. Rd., West Dist., Taichung (TW)

( * ) Notice: Subject to any disclaimer, the term of this patent is extended or adjusted under 35 U.S.C. 154(b) by 0 days.
This patent is subject to a terminal disclaimer.

(21) Appl. No.: 11/028,564

(22) Filed: Jan. 5, 2005

(65) Prior Publication Data

US 2005/0120632 A1 Jun. 9, 2005

Related U.S. Application Data

(63) Continuation-in-part of application No. 10/843,567, filed on May 12, 2004, now Pat. No. 6,966,150, which is a continuation-in-part of application No. 10/411, 231, filed on Apr. 11, 2004, now Pat. No. 6,826,870.

(51) Int. Cl.
*E05D 7/08* (2006.01)

(52) U.S. Cl. ..... 49/388; 16/252

(58) Field of Classification Search ..... 49/388, 49/397, 399; 16/252, 334, 335; 52/204.58, 52/204.53, 204.54, 204.62, 204.65, 656.2, 52/656.4, 235, 656.9, 213
See application file for complete search history.

(56) References Cited

U.S. PATENT DOCUMENTS 5,867,869 A * 2/1999 Garrett et al. ..... 16/252
6,519,811 B1 * 2/2003 Cheng ..... 16/252
6,826,870 B1 * 12/2004 Chiang ..... 49/388
6,966,150 B1 * 11/2005 Chiang ..... 49/388

* cited by examiner

*Primary Examiner*—Jerry Redman
(74) *Attorney, Agent, or Firm*—Fei-Fei Chao; Andrews Kurth LLP

(57) ABSTRACT

An adjustable hinge has a doorframe mount, a body, a spindle, a door bracket, at least one positioning device and an adjusting assembly. The body is securely attached to the doorframe mount. The spindle is mounted in the body and has an exterior surface with a middle portion. The door bracket is pivotally connected to the body with the spindle to attach to the glass panel of the glass door. The at least one positioning device is mounted between the door bracket and the spindle to position the glass panel in a specific position. The adjusting assembly is mounted between the body and the spindle and has a holding device and an adjusting device. The holding device is mounted on the middle portion of the spindle. The adjusting device is mounted in the body and fits with the holding device on the spindle.

8 Claims, 9 Drawing Sheets

ADJUSTABLE AUTOMATIC POSITIONING HINGE FOR GLASS DOORS

CROSS REFERENCE TO RELATED APPLICATIONS

This application is a continuation-in-part (CIP) application of U.S. patent application Ser. No. 10/843,567, filed on May 12, 2004, which becomes U.S. Pat. No. 6,966,150 B1, issued on Nov. 22, 2005, which is a continuation-in-part application of patent application Ser. No. 10/411,231, filed on Apr. 11, 2004, which becomes U.S. Pat. No. 6,826,870, issued on Dec. 7, 2004, which are herein incorporated by reference.

BACKGROUND OF THE INVENTION

1. Field of the Invention

The present invention relates to an automatic positioning hinge for doors, and more particularly to an adjustable automatic positioning hinge for a glass door in a doorway system.

2. Description of Related Art

A glass door in a doorway system comprises a glass panel, a doorframe and two conventional hinges. The glass panel is pivotally mounted in the doorframe with the hinges. However, exact alignment of the glass panel with the doorframe is important because the glass door will not close completely when the glass panel is not aligned exactly with the doorframe.

However, accurately installing the glass panel in the doorframe with the hinges is difficult because the glass panel is generally bulky, as well as being extremely heavy due to the security and strength requirements. If the glass panel is not be exactly aligned with the doorframe, small adjustments will be needed to align the glass panel exactly with the doorframe. Conventional hinges in accordance with prior art for glass doors are complex to assemble and cannot be adjusted to align the glass panel with the doorframe after the glass panel has been mounted on the doorframe.

Therefore, installing the glass panel in the doorframe with conventional hinges requires talent and experience or repeated assembly, disassembly and reassembly to ensure the exact alignment of the glass panel with the doorframe. Installation of the glass door with the conventional hinges is inconvenient, slow and costly.

To overcome the shortcomings, the present invention provides an adjustable automatic positioning hinge for a glass door to mitigate or obviate the aforementioned problems.

SUMMARY OF THE INVENTION

The main objective of the invention is to provide a simple adjustable automatic positioning hinge for a glass door comprised of a glass panel, a doorframe and multiple hinges, by which small adjustments can be made to align the glass panel with the doorframe. The adjustable automatic positioning hinge has a doorframe mount, a body, a spindle, a door bracket, at least one positioning device and an adjusting assembly. The body is securely attached to the doorframe mount. The spindle is mounted in the body and has an exterior surface with a middle portion. The door bracket is pivotally connected to the body with the spindle to attach to the glass panel of the glass door. The at least one positioning device is mounted between the door bracket and the spindle to position the glass panel in a specific position. The adjusting assembly is mounted between the body and the spindle and comprises a holding device and an adjusting device. The holding device is mounted on the middle portion of the exterior surface of the spindle. The adjusting device is mounted in the body and fits with the holding device on the spindle. Consequently, the structure of the adjustable hinge is simplified, and small adjustments can be made to align the glass panel with the doorframe of the glass door with the adjusting assembly when the glass panel is not exactly aligned.

Other objectives, advantages and novel features of the invention will become more apparent from the following detailed description when taken in conjunction with the accompanying drawings.

DETAILED DESCRIPTION OF PREFERRED EMBODIMENT

Figure 1:
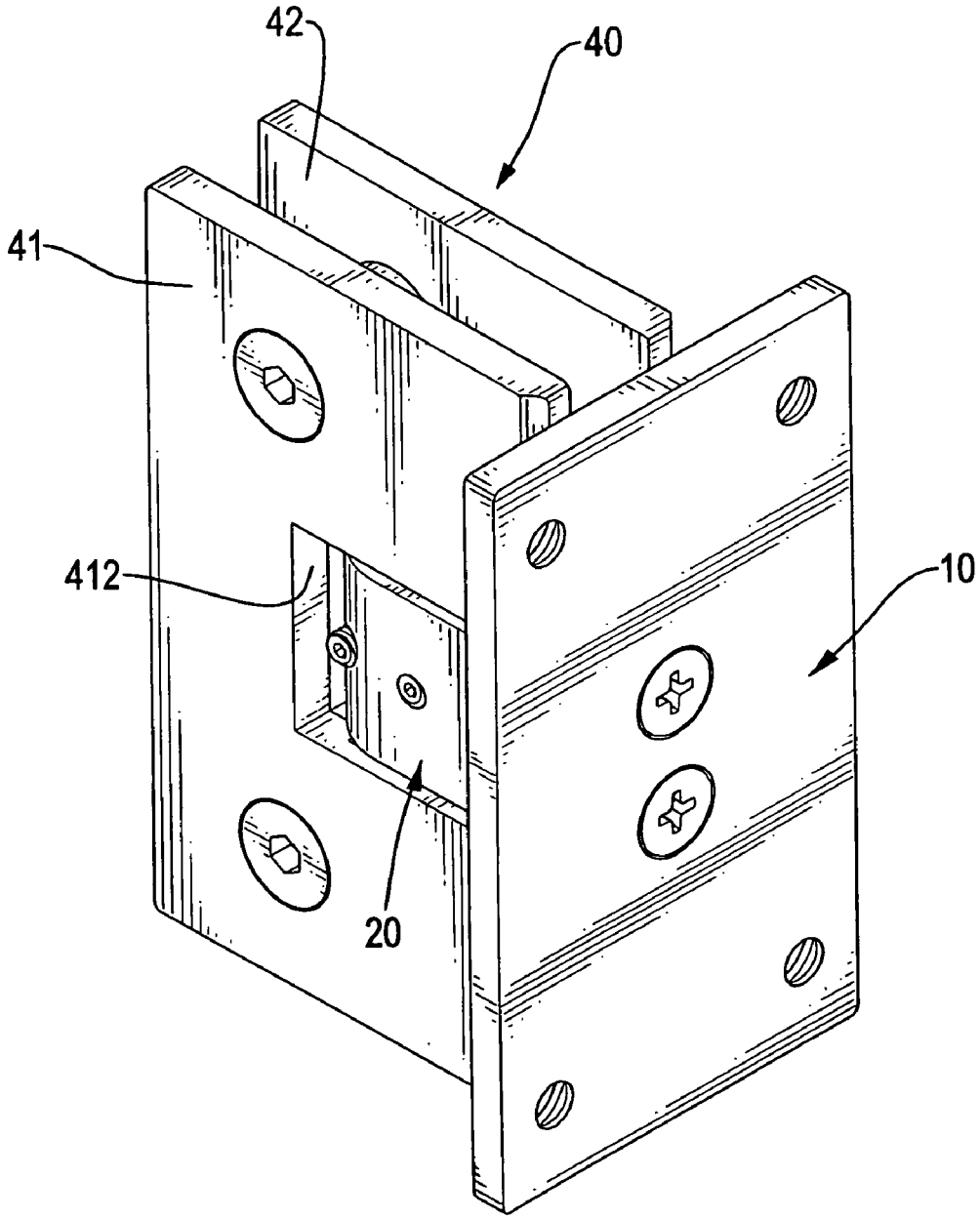
FIG. 1 is a perspective view of a first embodiment of an adjustable hinge in accordance with the present invention.
Figure 2:
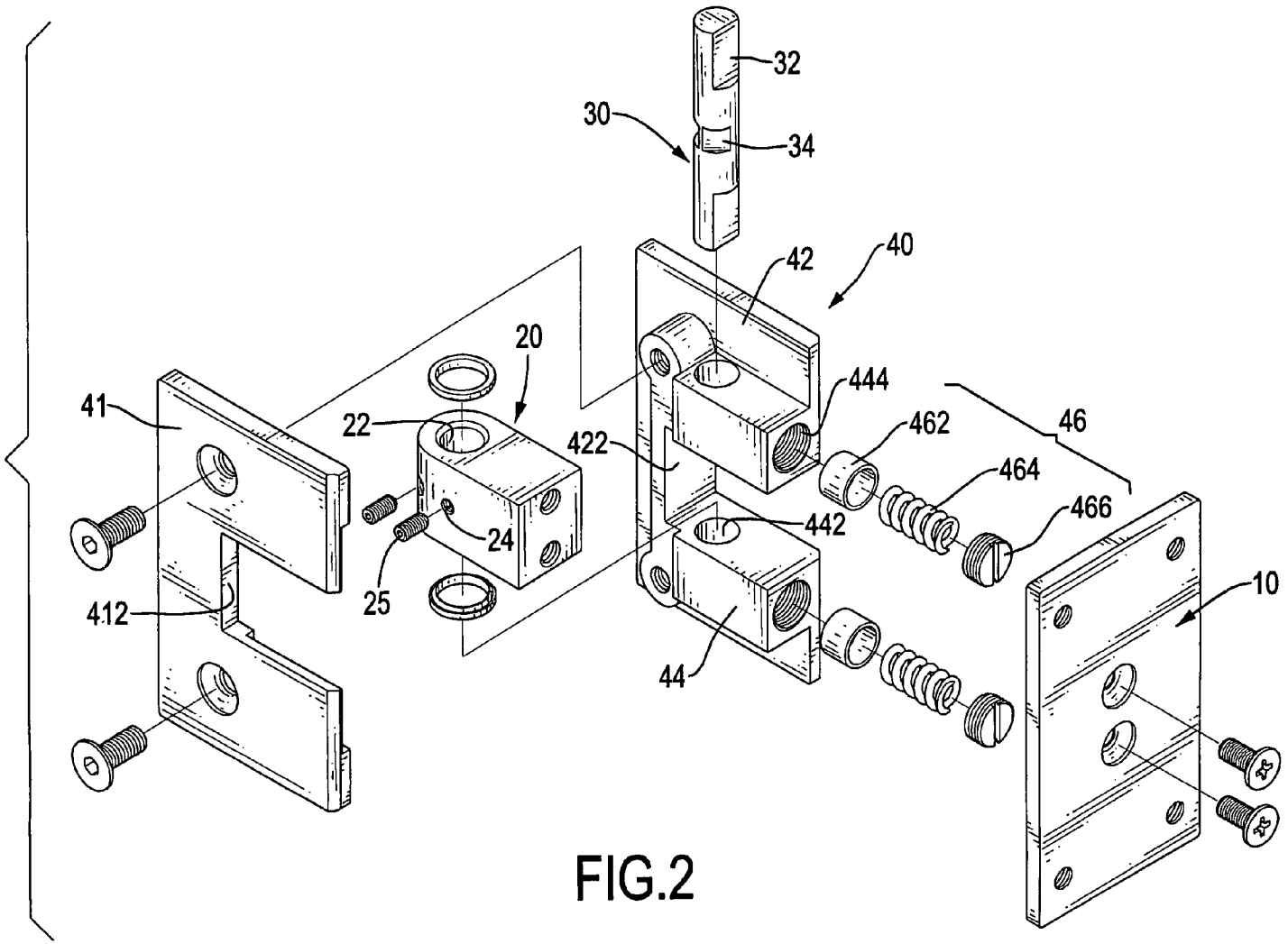
FIG. 2 is an exploded perspective view of the adjustable hinge in FIG. 1.
Figure 3:
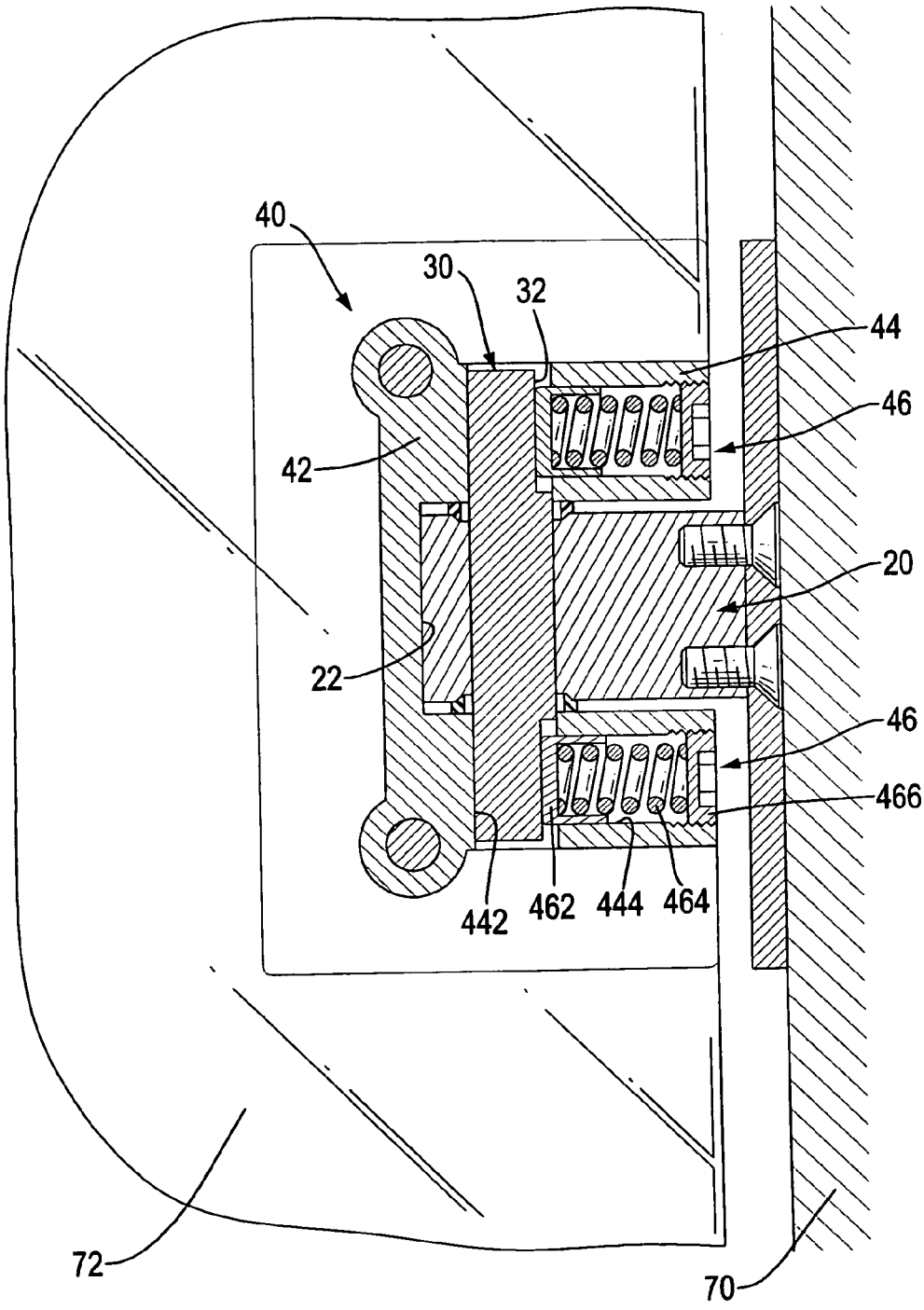
FIG. 3 is a side plan view in partial section of a glass door with the adjustable hinge in FIG. 1.

With reference to FIGS. 1 to 3, an adjustable automatic positioning hinge for a glass door in accordance with the present invention comprises a doorframe mount (10), a body (20), a spindle (30), a door bracket (40), at least one positioning device (46) and an adjusting assembly. The doorframe mount (10) is securely attached to a doorframe (70) of the glass door. The body (20) is securely attached to the doorframe mount (10). A spindle hole (22) is defined through the body (20). The spindle (30) is mounted in the spindle hole (22) in the body (20) and has an exterior surface with a middle portion and two ends exposed from the spindle hole (22).

The door bracket (40) is pivotally connected to the body (20) with the spindle (30) to attach to a glass panel (72) of the glass door. The door bracket (40) comprises a male bracket (42) and a female bracket (41). The male bracket (42) has a cavity (422) and two protrusions (44) formed respectively at two sides of the cavity (422). Each protrusion (44) has a spindle hole (442) aligning with the spindle hole (22) in the body (20), and two ends of the spindle (30) extend respectively into the spindle holes (442) in the protrusions (44). The female bracket (41) is attached to the male bracket (42) and has a cavity (412) to hold the body (20) in cooperation with the cavity (422) in the male bracket (42). Accordingly, the glass panel (72) is clamped between the female and male brackets (41,42) to securely attach to the door bracket (40).

The at least one positioning device (46) is mounted between the door bracket (40) and the spindle (30) to position the glass panel (72) in a specific position. In a preferred embodiment, the hinge has two positioning devices (46) mounted in the door bracket (40). Each positioning device (46) comprises a threaded hole (444), an inner cap (462), a biasing member (464), and an outer plug (466). Two positioning flats (32) are formed on opposed ends of the spindle (30) and face the same direction. The threaded hole (444) is defined in one of the protrusions (44) on the male bracket (42) and communicates with the spindle hole (442) in the protrusion (44). The inner cap (462) is mounted inside the threaded hole (444). The biasing member (464) is mounted inside the threaded hole (444) and presses against the inner cap (462). The outer plug (466) is screwed into the threaded hole (444) to close the threaded hole (444) and to hold the inner cap (462) and the biasing member (464) inside the threaded hole (444). The inner cap (462) selectively abuts the respective positioning flat (32) of the spindle (30).

With the positioning devices (46), the glass panel (72) is held in a closed position by the inner caps (462) pressing respectively against the positioning flats (32) on the spindle (30). Pulling or pushing the glass panel (72) will open the glass door and will pivot the glass panel (72) and the spindle (30). The inner caps (462) slide respectively out of full contact with the positioning flats (32) and compress the biasing member (464). The compressed biasing member (464) press the inner caps (462) that cause the spindle (30) to rotate until the inner caps (462) are in full contact with the positioning flats (32) again, such that the glass door will automatically close.

Figure 4:
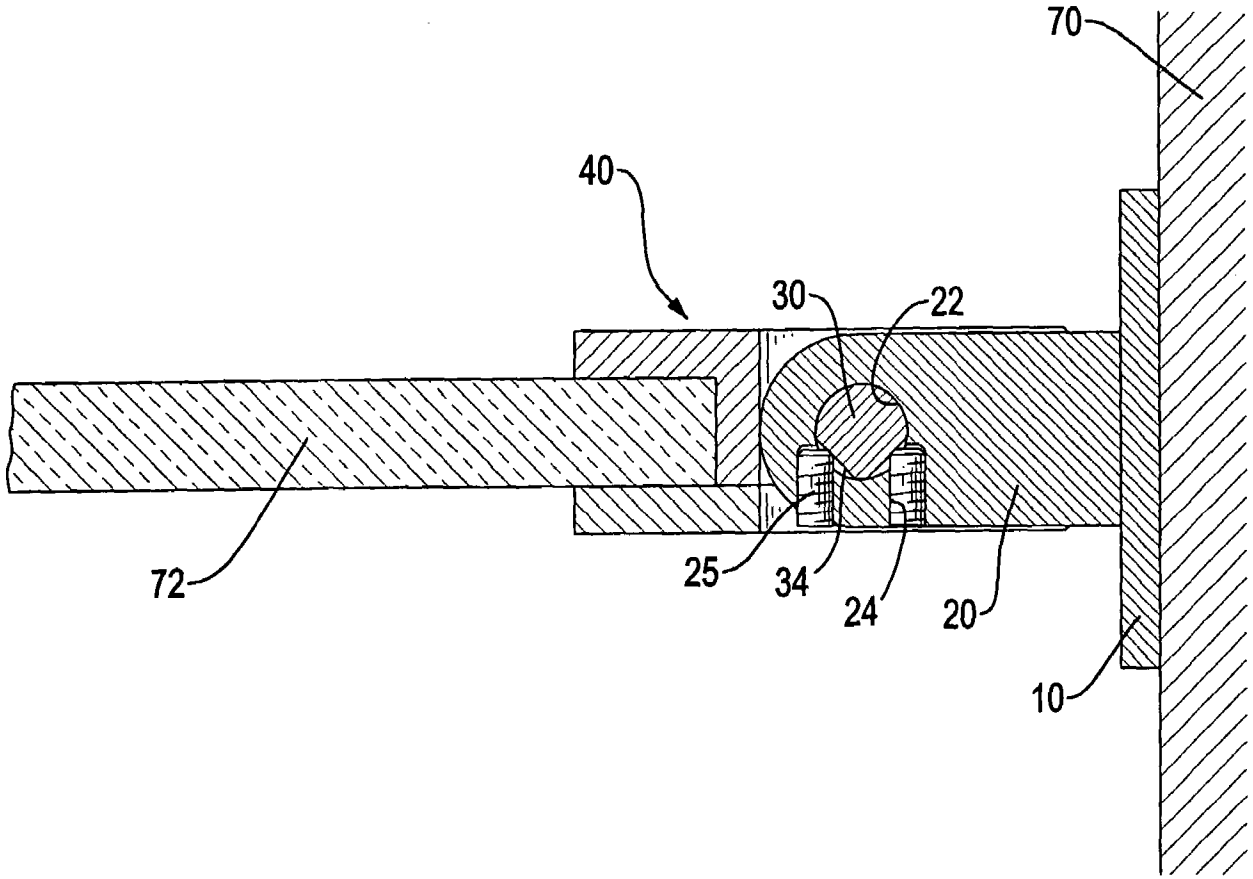
FIG. 4 is a top view in partial section of the glass door with the adjustable hinge in FIG. 3.

With further reference to FIG. 4, the adjusting assembly is mounted between the body (20) and the spindle (30) and comprises a holding device and an adjusting device. The holding device is mounted on the middle portion of the exterior surface of the spindle (30), and the adjusting device is mounted in the body (20) and fits with the holding device on the spindle (30). In a first embodiment, the holding device comprises two inclined adjusting flats (34) defined together in the middle portion of the exterior surface of the spindle (30), to form a V-like portion. The adjusting device comprises two threaded holes (24) and two adjusting screws (25). The threaded holes (24) are defined in the body (20) and communicate with the spindle hole (22) in the body (20). The adjusting screws (25) are screwed respectively into and held respectively in the threaded holes (24) in the body (20), and each adjusting screw (25) has an inside end abutting one of the inclined adjusting flats (34) on the spindle (30).

Figure 5:
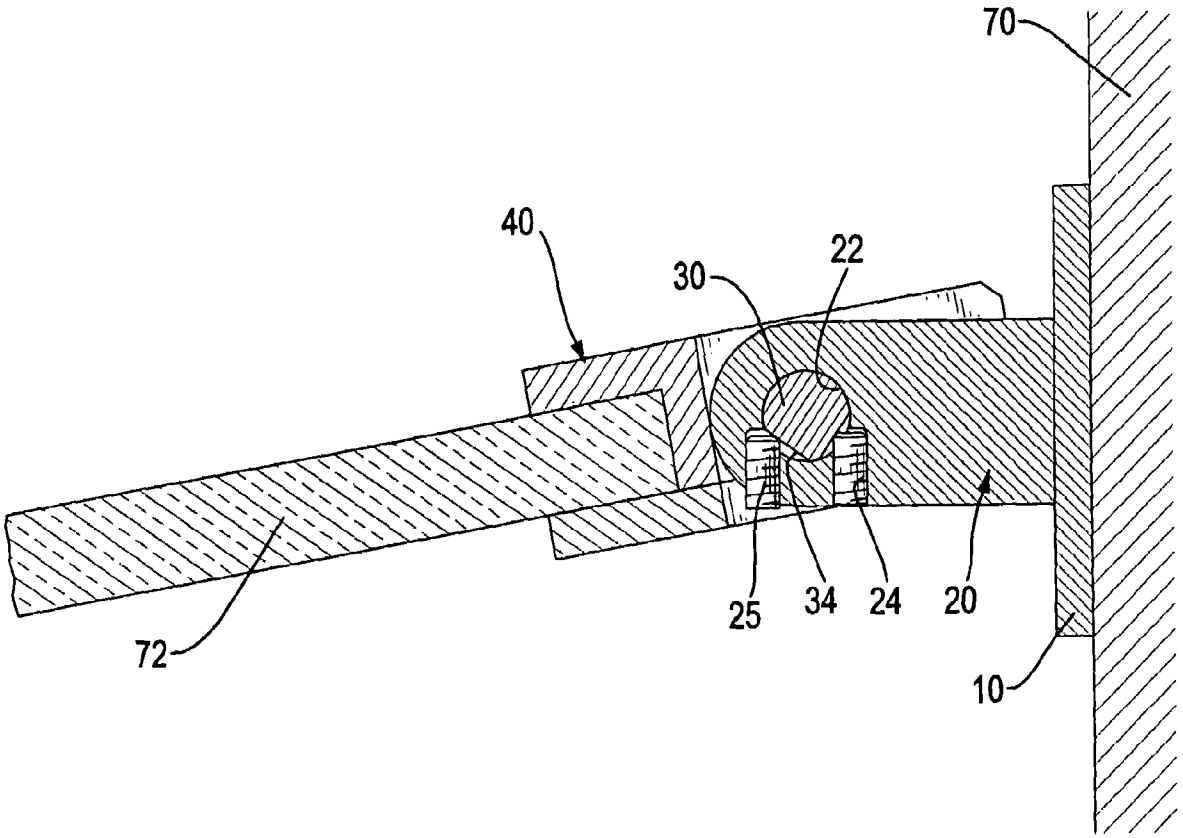
FIG. 5 is an operational top view in partial section of the adjustable hinge in FIG. 4 when a small adjustment is made to the glass panel of a glass door with the adjustable hinge.

With further reference to FIG. 5, the adjusting screws (25) are used to deflect the closed position of the glass panel (72) relative to the doorframe (70) to align the glass panel (72) with the doorframe (70) when the glass panel (72) is askew. Screwing one of the adjusting screws (25) into the corresponding threaded hole (24) and backing the other adjusting screw (25) out of the corresponding threaded hole (24) causes the inside ends of the adjusting screws (25) that respectively abut the inclined adjusting flats (34) to change angular positions of the inclined adjusting flats (34) relative to the doorframe (70). The closed position of the glass panel (72) can be adjusted any amount by changing angular positions of the inclined adjusting flats (34). Exact alignment of the glass panel (72) with the doorframe (70) can be accomplished by the adjusting screws (25).

Figure 6:
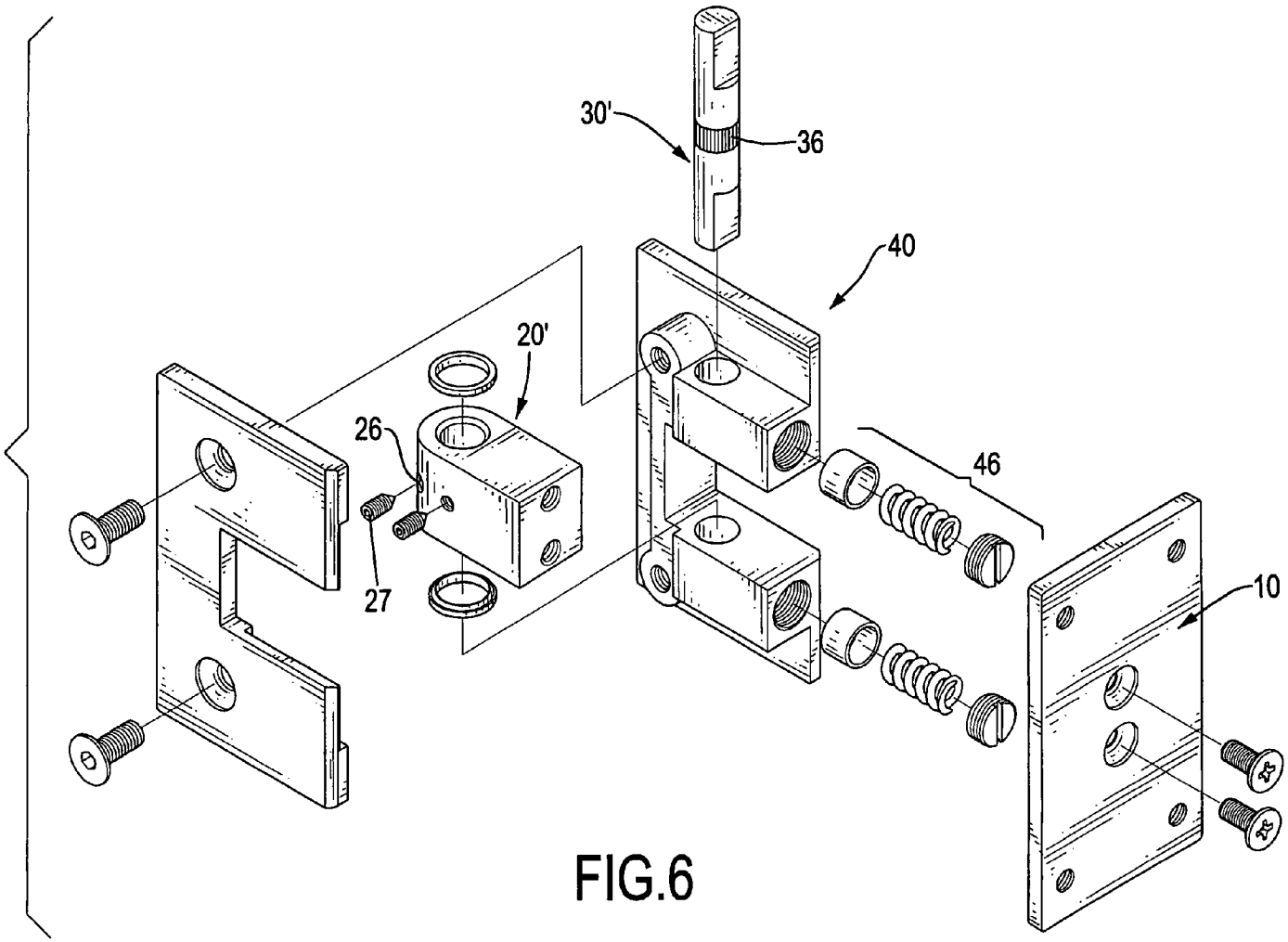
FIG. 6 is an exploded perspective view of a second embodiment of an adjustable hinge in accordance with the present invention.
Figure 7:
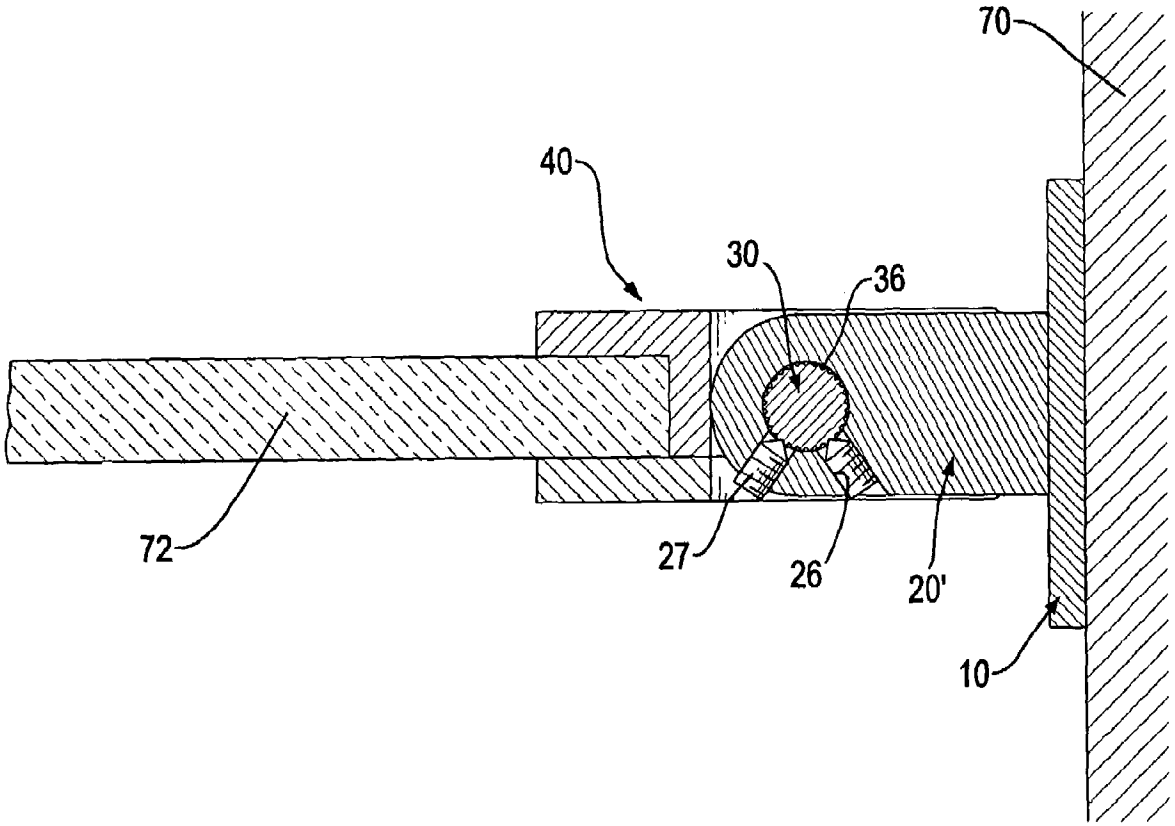
FIG. 7 is a top view in partial section of a glass door with the adjustable hinge in FIG. 6.

With reference to FIGS. 6 and 7, a second embodiment of the adjusting assembly is shown. The holding device of the adjusting assembly comprises multiple teeth (36) formed around the middle portion of the exterior surface of the spindle (30'). The adjusting device of the adjusting assembly comprises two threaded holes (26) and two adjusting screws (27). The threaded holes (26) are defined in the body (20') and communicate with the spindle hole in the body (20'). The adjusting screws (27) are screwed respectively into and held in the threaded holes (26) in the body (20'), and each adjusting screw (27) has an inside end abutting one of the teeth (36) on the spindle (30'). With the engagement of the adjusting screws (27) and the teeth (36) on the spindle (30'), the spindle (30') will held in place relative to the body (20').

When the glass panel (72) does not exactly align with the doorframe (70), the adjusting screws (27) are rotated to back out of the corresponding threaded holes (26). Consequently, the spindle (30') can be rotated relative to the body (20') to change the angular position of spindle (30') with the door bracket (40) relative to the body (20'), such that exact alignment of the glass panel (72) with the doorframe (70) can be accomplished after the adjusting screws (27) reengage with the teeth (36) on the spindle (30').

Figure 8:
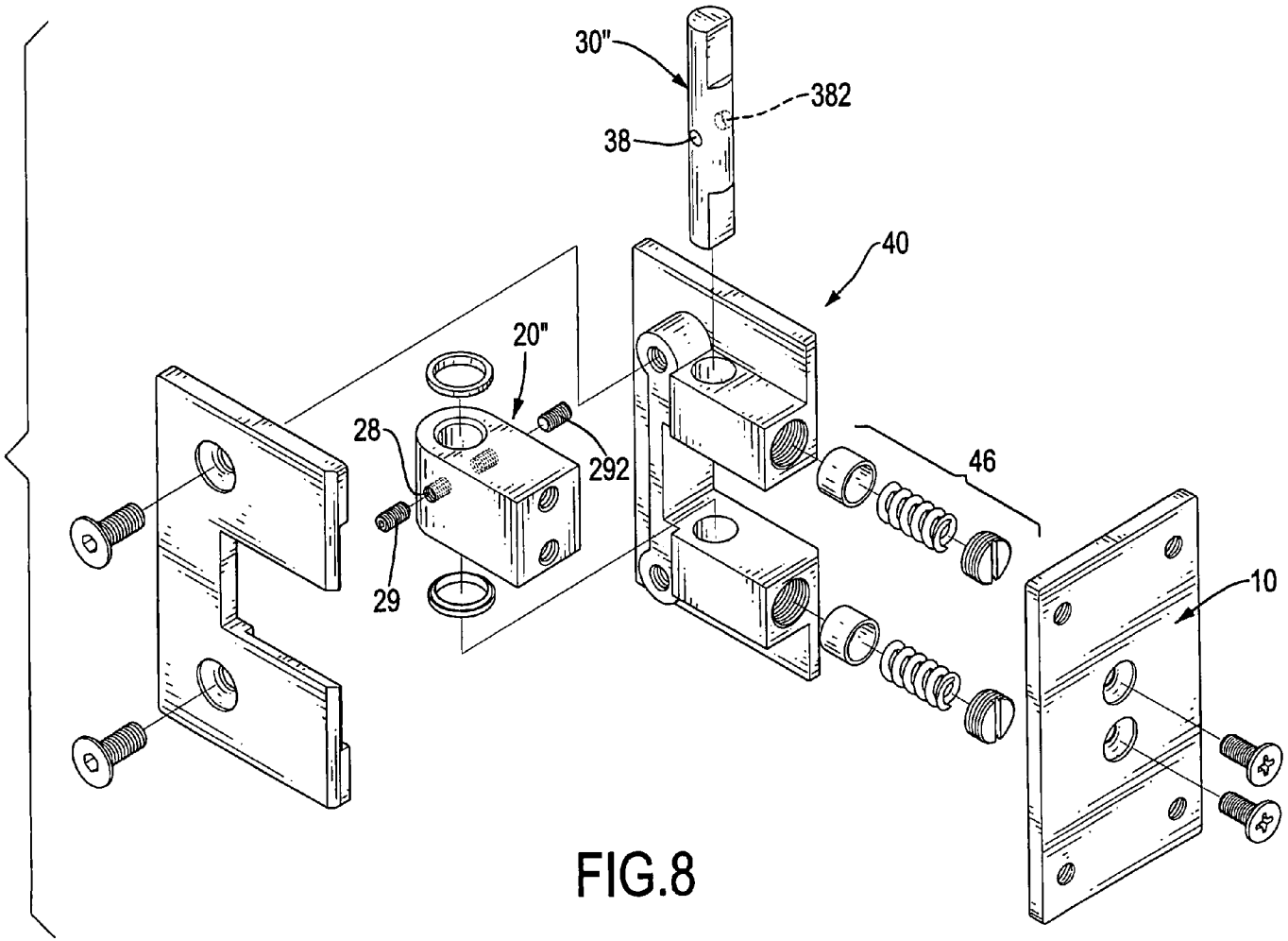
FIG. 8 is an exploded perspective view of a third embodiment of an adjustable hinge in accordance with the present invention.
Figure 9:
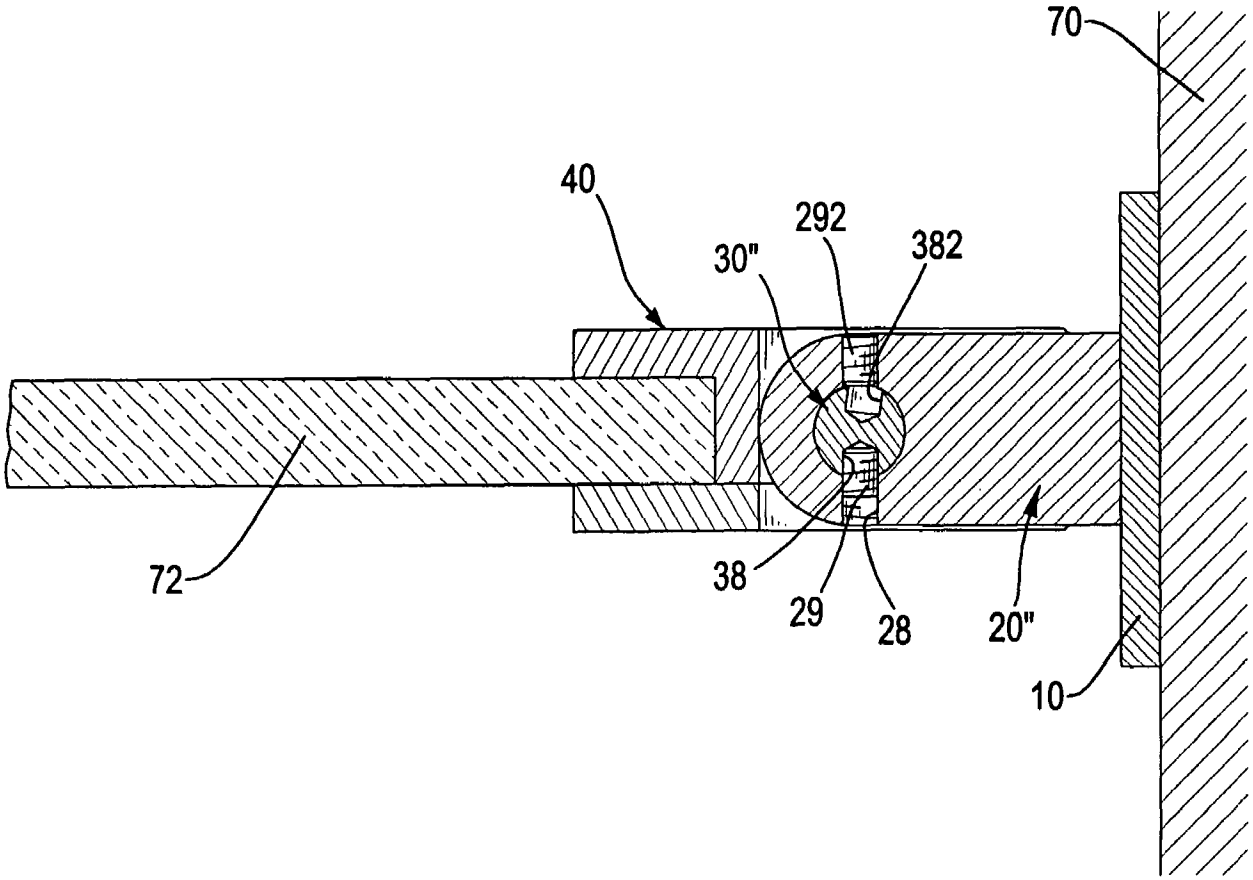
FIG. 9 is a top view in partial section of a glass door with the adjustable hinge in FIG. 8.

With reference to FIGS. 8 and 9, the holding device of the adjusting assembly may comprise two adjusting holes (38, 382) defined in the middle portion of the exterior surface of the spindle (30") and located at two non-aligned radiuses of the spindle (30"). The adjusting device of the adjusting assembly comprises two threaded holes (28) and two adjusting screws (29,292). The threaded holes (28) are defined in the body (20") and communicate with the spindle hole in the body (20"), and the threaded holes (28) in the body (20") will not simultaneously align with the adjusting holes (38, 382) in the spindle (30").

The adjusting screws (29,292) are screwed respectively into and held respectively in the threaded holes (28) in the body (20"), and each adjusting screw (29,292) has an inside end selectively extendable into one of the adjusting holes (38,382) in the spindle (30"). With the arrangement between the adjusting holes (38,382) in the spindle (30") and the threaded holes (28) in the body (20"), only one of the adjusting screws (29,292) will extend into the corresponding adjusting hole (38,382) at one time.

When the glass panel (72) does not exactly align with the doorframe (70), the adjusting screw (29) is rotated to back out of the corresponding adjusting hole (28). The spindle (30") is then rotated to make the other adjusting hole (382) align with the corresponding threaded hole (28), such that the angular position of spindle (30") with the door bracket (40) relative to the body (20") will be changed. Accordingly, exact alignment of the glass panel (72) with the doorframe (70) can be accomplished after the adjusting screw (292) is rotated to extend into the corresponding adjusting hole (382) in the spindle (30").

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. An adjustable automatic positioning hinge for a glass door and the adjustable hinge comprising:

a doorframe mount;

a body securely attached to the doorframe mount;

a spindle mounted in the body and having an exterior surface with a middle portion;

a door bracket pivotally connected to the body with the spindle to attach to a glass panel of the glass door;

at least one positioning device mounted between the door bracket and the spindle to position the glass panel in a specific position; and an adjusting assembly mounted between the body and the spindle and comprising a holding device mounted on the middle portion of the exterior surface of the spindle; and an adjusting device mounted in the body and fitting with the holding device on the spindle, wherein the body has a spindle hole;

wherein the door bracket comprises:

a male bracket having a cavity and two protrusions formed respectively at two sides of the cavity and each having a spindle hole aligning with the spindle hole in the body; and a female-bracket attached to the male bracket and having a cavity to hold the body in cooperation with the cavity in the male bracket: and wherein the spindle is rotatably mounted inside the spindle holes in the body and the door bracket.

2. The adjustable automatic positioning hinge as claimed in claim 1, wherein each one of the at least one positioning device comprises a threaded hole defined in one of the protrusions on the male bracket and communicating with the spindle hole in the protrusion;

an inner cap mounted inside the threaded hole;

a biasing member mounted inside the threaded hole and pressing against the inner cap;

an outer plug screwed into the threaded hole to close the threaded hole and to hold the inner cap and the biasing member inside the threaded hole; and a positioning flat defined in one end of the spindle and selectively abutting with the inner cap.

3. The adjustable automatic positioning hinge as claimed in claim 2, wherein the holding device of the adjusting assembly comprises two inclined adjusting flats defined in the middle portion of the exterior surface of the spindle; and the adjusting device of the adjusting assembly comprises two threaded holes defined in the body and communicating with the spindle hole in the body; and two adjusting screws screwing respectively into and held in the threaded holes in the body and each having an inside end abutting one of the inclined adjusting flats on the spindle.

4. The adjustable automatic positioning hinge as claimed in claim 2, wherein the holding device of the adjusting assembly comprises multiple teeth formed around the middle portion of the exterior surface of the spindle; and the adjusting device of the adjusting assembly comprises two threaded holes defined in the body and communicating with the spindle hole in the body; and two adjusting screws screwing respectively into and held in the threaded holes in the body and each having an inside end abutting one of the teeth on the spindle.

5. The adjustable automatic positioning hinge as claimed in claim 2, wherein the holding device of the adjusting assembly comprises two adjusting holes defined in the middle portion of the exterior surface of the spindle and located at two non-aligned radiuses of the spindle; and the adjusting device of the adjusting assembly comprises two threaded holes defined in the body and communicating with the spindle hole in the body; and two adjusting screws screwing respectively into and held in the threaded holes in the body and each having an inside end selectively extendable into one of the adjusting holes in the spindle, wherein the threaded holes in the body will not simultaneously align with the adjusting holes in the spindle.

6. The adjustable automatic positioning hinge as claimed in claim 1, wherein the holding device of the adjusting assembly comprises two inclined adjusting flats defined in the middle portion of the exterior surface of the spindle; and the adjusting device of the adjusting assembly comprises two threaded holes defined in the body and communicating with the spindle hole in the body; and two adjusting screws screwing respectively into and held in the threaded holes in the body and each having an inside end abutting one of the inclined adjusting flats on the spindle.

7. The adjustable automatic positioning hinge as claimed in claim 1, wherein the holding device of the adjusting assembly comprises multiple teeth formed around the middle portion of the exterior surface of the spindle; and the adjusting device of the adjusting assembly comprises two threaded holes defined in the body and communicating with the spindle hole in the body; and two adjusting screws screwing respectively into and held in the threaded holes in the body and each having an inside end abutting one of the teeth on the spindle.

8. The adjustable automatic positioning hinge as claimed in claim 1, wherein the holding device of the adjusting assembly comprises two adjusting holes defined in the middle portion of the exterior surface of the spindle and located at two non-aligned radiuses of the spindle; and the adjusting device of the adjusting assembly comprises two threaded holes defined in the body and communicating with the spindle hole in the body; and two adjusting screws screwing respectively into and held in the threaded holes in the body and each having an inside end selectively extendable into one of the adjusting holes in the spindle, wherein the threaded holes in the body will not simultaneously align with the adjusting holes in the spindle.

* * * * *